US006551563B1

(12) United States Patent
Kado et al.

(10) Patent No.: US 6,551,563 B1
(45) Date of Patent: Apr. 22, 2003

(54) METHODS AND SYSTEMS FOR SAFELY PROCESSING HAZARDOUS WASTE

(75) Inventors: Yuji Kado, Fairfax, VA (US); John F. Kantak, Alexandria, VA (US); Jay Ramamurthi, Herndon, VA (US); Mark E. Vetter, Bowie, MD (US)

(73) Assignee: Vanguard Research, Inc., Fairfax, VA (US)

( * ) Notice: Subject to any disclaimer, the term of this patent is extended or adjusted under 35 U.S.C. 154(b) by 0 days.

(21) Appl. No.: 09/667,673

(22) Filed: Sep. 22, 2000

(51) Int. Cl.[7] ..... B01J 19/08
(52) U.S. Cl. ..... 422/186.21; 119/235
(58) Field of Search ..... 422/186.21; 110/346, 110/235

(56) References Cited

U.S. PATENT DOCUMENTS 3,779,182 A 12/1973 Camacho et al.
3,841,239 A 10/1974 Nakamura et al.
4,181,504 A 1/1980 Camacho
4,438,706 A 3/1984 Boday et al.
4,479,443 A 10/1984 Faldt et al.
4,508,040 A 4/1985 Santen et al.
4,615,285 A 10/1986 Bentell et al.
4,770,109 A 9/1988 Schlienger
4,831,944 A 5/1989 Durand et al.
4,980,092 A 12/1990 Pineau et al.
4,989,522 A 2/1991 Cline et al.
4,998,486 A 3/1991 Dighe et al.
5,090,340 A 2/1992 Burgess
5,095,828 A 3/1992 Holden et al.
5,127,347 A 7/1992 Cheetham
5,134,946 A 8/1992 Poovey
5,143,000 A 9/1992 Camacho
5,280,757 A 1/1994 Carter et al.
5,319,176 A 6/1994 Alvi et al.
5,534,659 A 7/1996 Springer et al.

*Primary Examiner*—K. Mayekar
(74) *Attorney, Agent, or Firm*—Womble Carlyle Sandridge & Rice, PLLC

(57) ABSTRACT

The safe operation of pyrolytic-based, hazardous waste processing systems is accomplished by rapidly controlling an oxygen to product gas ratio and pressures within such systems.

23 Claims, 1 Drawing Sheet

METHODS AND SYSTEMS FOR SAFELY PROCESSING HAZARDOUS WASTE

This invention was made with Government support under contract #97RKW-224746 awarded by the Tennessee Valley Authority. The Government has certain rights in the invention.

BACKGROUND OF THE INVENTION

The risks involved in the operation of hazardous waste sites have been chronicled in the popular media from movies, to books to newspapers. We are all too familiar with the dangers of being exposed to hazardous and/or toxic waste hereafter (collectively referred to as "hazardous waste") from such sites. Concerned about the public's health, both government and industry have sought to develop ways to safely destroy such hazardous waste.

One of the most commonly accepted ways to destroy hazardous waste is by using an incinerator. Incinerators have their drawbacks, however. Unfortunately, incinerators are not capable of destroying certain types of hazardous waste such as polychlorinated biphenyls, asbestos, heavy metal sludges, complex organics and pesticide waste. Incinerators generate their own hazardous waste byproducts, such as toxic ash, when processing hazardous waste.

Some have attempted to develop "pyrolytic" or "pyrolysis-based" systems (i.e., systems which destroy, process and handle waste in an oxygen reduced atmosphere to avoid burning or combustion) (hereafter referred to as "pyrolytic system") as an alternative to incineration. One such system is disclosed in U.S. Pat. No. 5,534,659 to Springer, et al ("Springer").

In general, Springer discloses the use of a "plasma" torch in a pyrolytic system. Because plasma torches can be used to generate extremely high temperatures in an oxygen reduced atmosphere, they are capable of destroying, through pyrolysis, hazardous material which cannot be destroyed by incineration.

However, attempts to build or use existing pyrolytic systems or methods have not proven to be safe or successful ("existing" means systems, methods or devices other than those discovered by the present inventors). Moreover, attempts to practice the ideas embodied in some existing systems and methods have proven to be downright dangerous.

It has been determined through experimentation that existing pyrolytic systems and methods fail to appreciate the need for "real-time" controls over each step in the destruction, processing and handling (collectively referred to as "processing") of hazardous waste. It has long been known that the pyrolytic destruction of hazardous wastes generates flammable and potentially explosive byproducts, such as carbon monoxide or hydrogen.

Experimentation using existing systems and methods, such as the one disclosed in Springer, revealed flaws and safety issues in their processing and control systems.

Pyrolytic waste processing systems which do not have effective, automatic controls are unsafe to operate. Only automatic controls which react rapidly or almost instantaneously can operate quickly enough to react to changes taking place within the system.

Many changes may occur within a pyrolytic system which, if not adequately controlled, may make the system unsafe to operate. One source of concern are changes in the ratio of oxygen to product gas within the system. More specifically, the fluctuation of the concentration of oxygen in a flammable product gas stream is of great concern. A number of things may cause the concentration of oxygen to fluctuate. First, a particular type of hazardous waste (e.g., medical waste) may comprise a number of different constituents. For example, medical waste comprises a combination of cloth, paper, cardboard, plastic, solvents, metal and/or glass. When each of these constituents is fed into a waste processing system, different types and amounts of byproduct gasses ("product gasses") are released as they are processed. As a result, the ratio of oxygen to product gas (by volume) within the system may fluctuate, sometimes rapidly.

If the ratio is not closely monitored and rapidly controlled, the ratio may exceed safe levels and an explosion may occur.

Second, a similar situation occurs when more than one type of hazardous waste is destroyed. For example, hazardous waste can be separated into organic and inorganic wastes (e.g., petrochemicals and asbestos). In general, organic wastes release different types and amounts of product gas compared to inorganic wastes. If the same pyrolytic waste processing system is used to destroy both inorganic and organic wastes, the different product gasses released by each type of waste will also tend to make the ratio of oxygen to product gas within the system fluctuate, sometimes widely and rapidly, as well.

In order to safely operate hazardous waste processing systems, such rapid fluctuations must be controlled very quickly.

Accordingly, it is desirable to provide methods and systems for safely processing hazardous waste.

It is further desirable to provide methods and systems for safely processing hazardous waste which take into account the rapid fluctuations in an oxygen to product gas ratio throughout an entire waste processing system.

Other desires will become apparent to those skilled in the art from the following description taken in conjunction with the drawings and claims.

SUMMARY OF THE INVENTION

In accordance with the present invention, there are provided methods and systems for safely processing hazardous waste undergoing pyrolysis. Such systems comprise a gas supply control unit adapted to switch a supply of gas from air to a sufficient amount of an inert gas, such as nitrogen, to a plasma arc torch, and supply a sufficient amount of an inert gas to a processing vessel, prechamber, feed chamber and other points in the system where air may enter the system; a waste feed control unit adapted to control a supply of waste to the processing vessel to help maintain the ratio; a pressure balancing control unit adapted to control pressures in the system; and an interlocking control unit adapted to halt operations within the system to protect against flame propagation.

Under certain circumstances, the gas supply control unit and waste feed control unit can be adapted to operate simultaneously.

While the gas supply and waste feed control units are adapted to regulate the amount of inert gas or waste fed into a system, the pressure balancing control unit is adapted to regulate the amount of gas pressure within the system by, for example, adjusting fan dampers.

Other novel systems envisioned by the present invention comprise gas supply lines adapted to inject a sufficient amount of an inert gas into components of the system in order to maintain a safe oxygen to product gas ratio.

Besides the systems described above, the present invention also envisions methods and programmed mediums (e.g., devices which store computer programs and/or code) adapted to control and carry out substantially the same features and functions.

The present invention and its advantages can be best understood with reference to the drawings, detailed description of the invention and claims that follow.

DETAILED DESCRIPTION OF THE INVENTION

Figure 1:
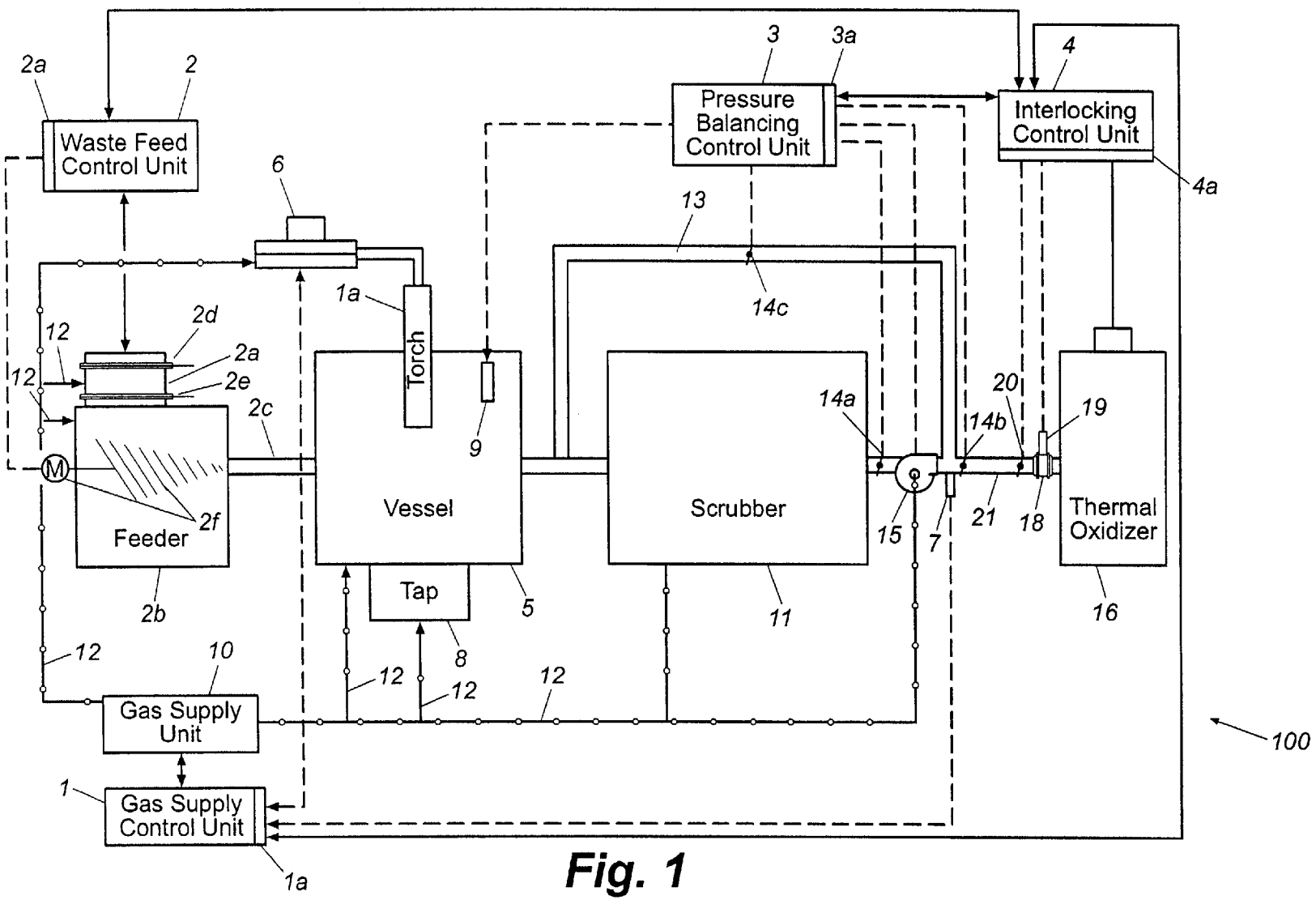
FIG. 1 depicts an example of a pyrolytic hazardous waste processing system according to one embodiment of the present invention.

Referring to FIG. 1, there is shown a system 100 adapted to safely process hazardous waste according to one embodiment of the present invention.

As shown, the system 100 comprises gas supply control unit or means 1; waste feed control unit or means 2; pressure balancing control unit or means 3, and interlocking control unit or means 4 to name just some of the components of the system 100.

The present inventors realized that to ensure the safe processing of different constituents and types of hazardous wastes in a pyrolytic system required the instantaneous control of the ratio of oxygen to product gas (by volume) throughout the entire system 100. The present inventors discovered that existing systems did not realize how difficult it was to maintain the oxygen to product gas ratio within safe levels, in real-time.

Throughout the discussion above and below reference will be made to "rapid", "real-time" or "instantaneous" (or variations of these words) controls, switching, or adjustments. It should be understood that these terms mean that actions are carried out quickly, most often by automatic control units and/or switches within a fraction of a second. Such control units and switches typically comprise, for example, a combination of electrical, electronic, electromechanical, mechanical and optoelectronic devices which may themselves be controlled by computer programs, program code or the like.

The present invention envisions controlling this critical oxygen to product gas ratio in a number of different ways. It has been found by the present inventors that maintaining a ratio below 3% allows for the safe processing of hazardous waste, especially when it comes to the processing of highly organic waste. More specifically, when hazardous waste is fed into a processing vessel 5 it is immediately destroyed by the extreme temperatures generated by the plasma arc torch 1*a*. Almost as fast as the waste is destroyed, product gasses are generated after such destruction. Complex organic waste molecules dissociate at these extreme temperatures, and the atoms recombine to form molecules of much simpler product gasses. One such gas is hydrogen. Oxygen will also be present. It may enter the system as a component in the torch gas, through leaks, or may be formed by the dissociation of the waste or an oxidant (steam). As is known in the art, hydrogen and oxygen will react rapidly and, under certain conditions, violently. If the ratio of oxygen to product gas within vessel 5, or elsewhere in system 100, is sufficient, the combination can become explosive. Therefore, it is critical to ensure that the ratio of oxygen to product gas volume within the vessel 5 and throughout the system 100 is controlled and maintained below the allowable ratio of 3%.

In existing systems, plasma torches typically use air to generate a super-heated "plasma". This air is electrically ionized to a hot plasma "plume" and is introduced into a vessel to provide heat to the pyrolysis process. Air is the normal choice as a torch gas in existing systems, as compressed air is the least expensive gas available. Other compressed gasses, including inert gasses such as nitrogen, are more expensive.

As noted above, when the oxygen to product gas ratio begins to increase, it becomes necessary to reduce the level of oxygen to below 3% in system 100, especially in vessel 5. In an illustrative embodiment of the present invention, the gas supply control unit 1 is adapted to instantaneously control the switching of a gas supply from air to a sufficient amount of an inert gas (or vice-versa), such as nitrogen, fed to a plasma arc torch la from a gas supply unit 10 in order to maintain a ratio of oxygen to product gas of less than 3% by volume.

In an additional embodiment of the present invention, the gas supply control unit 1 can be adapted to instantaneously control the supply of the inert gas fed to torch 1*a* when the system 100 is first started or restarted. This is an added precaution to establish safe, initial operating conditions when the ratio may be at or near dangerous levels upon starting or restarting the system 100.

In an illustrative embodiment of the present invention, the gas supply control unit 1 comprises a manifold 6 which is adapted to instantaneously switch the supply of the gas fed to the torch 1*a* from air to the inert gas (or vice-versa) in response to signals received from at least one gas composition sensor 7.

It should be understood that after the gas composition sensor 7 detects that the level of oxygen to product gas has dropped to safe levels, the control unit 1 and manifold 6 can be adapted to instantaneously control the switching of the supply of gas fed to the torch 1*a* from an inert gas back to air.

The unit 1 and/or manifold 6 allow for the real-time switching of a gas fed to torch 1*a* between air and an inert gas or vice-versa. Because the control unit 1 is capable of rapidly switching the gas supplied to the torch 1*a*, while the torch continues to operate, it can be said that the present invention envisions switching the gas supplied to the torch 1*a* "on-the-fly".

It should be understood that prior to the present invention, when oxygen levels started to increase the only safe choice was to shut down the plasma torch. This causes an interruption in the processing of waste and necessitates restarting the system. Restarting a system is expensive. Interrupting the processing of waste for anything but a short amount of time increases the expense it takes to destroy the waste, causes an increase in wear-and-tear on torch electrodes, upsets process equilibrium and waste processing efficiencies, and could result in the emission of harmful product gasses. By switching the gas supplied to the torch 1*a* on-the-fly, the present invention reduces the number of interruptions and restarts associated with system 100.

The discussion so far has focused on supplying a sufficient amount of an inert gas to the torch 1*a* to maintain safe ratio levels. The present invention envisions supplying the inert gas to other parts of the system 100 as well.

As envisioned by one embodiment of the present invention, the gas supply control unit 1 is further adapted to instantaneously control a continuous supply of a sufficient amount of an inert gas fed to the processing vessel 5. The inert gas is continuously supplied to the processing vessel 5 as required in order to help maintain a safe ratio of oxygen to product gas.

Supplying the processing vessel 5 with nitrogen or another inert gas, in effect, displaces the oxygen in the processing vessel 5 and does not allow the volume of oxygen within vessel 5 and system 100 to increase to the point where the ratio of oxygen to product gas approaches 3% by volume.

As indicated above, it is necessary to maintain this ratio throughout the entire system 100, not just within vessel 5. In an illustrative embodiment of the present invention an inert gas is supplied at points where air infiltration occurs (i.e., where air may be intentionally or unintentionally let into the system 100). To this end, the present invention envisions additional controls throughout the system 100.

In an illustrative embodiment of the present invention, the gas supply control unit 1 is further adapted to instantaneously control a continuous supply of a sufficient amount of the inert gas fed to a prechamber 2*a* and feed chamber 2*b*. The prechamber 2*a* may comprise dual feed gates 2*d* and 2*e*. The feed chamber 2*b* may comprise a variable speed auger 2*f* or the like adapted to feed waste into the processing vessel 5 via a feed conduit 2*c* according to signals sent from waste feed control unit 2.

Inert gas is fed to the prechamber 2*a* in order to displace any oxygen which is let into the prechamber 2*a* when a first feed gate 2*d* is opened. Opening the feed gate 2*d* is unavoidable; it must be opened to allow waste into the prechamber 2*a*. In an illustrative embodiment of the invention, after waste is let into the chamber 2*a* the feed gate 2*d* is then closed, and the gas supply control unit 1 is adapted to continuously supply a sufficient amount of the inert gas into the prechamber 2*a* to reduce (or maintain) the level of oxygen to ensure that the volumetric concentration of oxygen within prechamber 2*a* remains under 3%. When a second gate 2*e* is then opened to allow the waste into the feed chamber 2*b*, the volume of oxygen will already be at an acceptable level.

Normally, feed gates 2*d* and 2*e* are leak-proof. That is, when they are closed no air leaks through them into chamber 2*b*. Nonetheless, the present invention takes little for granted. As the system 100 ages, so will the gates 2*d*, 2*e*. In the event they start to leak, especially gate 2*e*, air could leak into the feed chamber 2*b*. To account for such leaks, in an illustrative embodiment of the present invention, the gas supply control unit 1 is adapted to instantaneously control the continuous supply of sufficient amount of the inert gas into the chamber 2*b* to maintain the ratio at a safe level.

The gates 2*d*, 2*e* are not the only place where air might be drawn into the system 100. Two other common locations are at the tap 8, and the draft fan(s) 15.

Air could leak into the vessel 5 and system 100 when the tap 8 is opened to remove molten material (sometimes referred to as "slag") from the vessel 5. Air also leaks into the system 100 when the shaft seals on draft fan(s) 15 become worn causing air from the outside of the system 100 to be drawn in, in addition to drawing product gas through the system 100.

These leaks, and others, must be controlled. In an alternative embodiment of the present invention, the control unit 1 may be further adapted to instantaneously control the continuous supply of an inert gas fed to tap 8 and draft fan(s) 15 as well as other parts of the system 100 in order to maintain the ratio at a safe level.

The locations mentioned above (torch 1*a*, prechamber 2*a*, feed chamber 2*b*, vessel 5, tap 8 and draft fan(s) 15) are only some examples of places where air may leak into the system 100. The present invention envisions alternative embodiments where the unit 1 is adapted to instantaneously control the supply of an inert gas fed to those places in system 100 (either continuously or on demand) where air may leak or otherwise infiltrate into system 100 in order to maintain the oxygen to product gas ratio below3%.

Maintaining safe oxygen to product gas ratios not only requires control units like unit 1, but it also requires gas supply lines 12 which are adapted to adequately supply, transport and inject (referred to collectively as "inject") volumes of the inert gas needed to keep the ratio at a safe level. Referring back to FIG. 1, system 100 further comprises gas supply lines 12 which are adapted to inject the sufficient amounts of inert gas from gas supply unit 10 to different parts of the system 100.

It should be understood that the present invention envisions alternative embodiments where the control unit 1 is adapted to instantaneously control the supply of inert gas fed to one or more of the locations discussed above. Further, it should be understood that the capability of controlling the type of gas (i.e., air or an inert gas) supplied to the torch 1*a* while at the same time controlling the continuous supply of the inert gas to other parts of the system 100 was developed by the present inventors only after a significant amount of experimentation.

Up until now, the discussion has focused on supplying parts of the system 100 with an inert gas in order to ensure that the ratio of oxygen to product gas is controlled. As envisioned by the present invention, another way to control the ratio of oxygen to product gas is to control the rate at which waste is fed into the processing vessel 5. In an illustrative embodiment of the present invention, the waste feed control unit 2 is adapted to instantaneously control a supply of waste into the processing vessel 5.

After a significant amount of experimentation, the present inventors discovered that without the ability to instantaneously control the rate at which waste is fed into the vessel 5, it was difficult to operate a pyrolytic system safely. By way of further explanation consider the following example. Suppose the type of waste being fed into the processing vessel 5 is medical waste. As stated above, such waste is made up of a number of constituents, such as cloth, paper, cardboard, plastic, solvents, metal and glass. Each of these constituents, when processed within the vessel 5, generates varying amounts of different product gasses. Over one period of time, all of the medical waste being fed into the vessel 1*a* may consist of paper and cardboard. In such a case, little fluctuation in the ratio of oxygen to product gas would be expected. However, if the constituents change to plastics and/or solvents, such a change could result in large and sudden fluctuations (so-called "spikes") in the flow of product gas and, consequently, in the ratio of oxygen to product gas throughout the system 100.

One way to minimize the risk to system 100 due to such fluctuations is to feed the waste at a continuously variable rate. That is, the present invention envisions a waste feed control unit 2 which is adapted to continuously decrease and/or increase (including stopping and starting) the rate at which waste is fed into the vessel 5. Continuously varying the feed rate enables control of the product gas flow and, consequently, the oxygen to product gas ratio within the system 100. It also allows different constituents of waste to be fed into the vessel 5 without endangering the safe operation of the system 100.

It should be understood that the present invention envisions a unit 2 which is adapted to continuously vary the speed at which the auger 2*f* feeds waste into the vessel 5 based on the type of waste constituent being fed into the vessel 5, not just the type of waste itself. This novel feature is worthy of a little more explanation.

It can be said that existing systems select the speed at which waste is continuously fed into a system depending upon the type of waste. Thus, medical waste may be fed faster or slower than, say, ammunition. To safely operate a pyrolytic waste processing system, however, more must be done. It is not enough to specify a speed for each type of waste. Instead, pyrolytic systems must be capable of varying the speed depending on the type of constituent making up each type of waste. It is the type of waste and its constituents, not just the type alone, which will ultimately cause rapid fluctuations in the product gas flow and, consequently, the oxygen to product gas ratio within the system 100.

Some simplified examples may help to explain this idea further. In existing systems, when the type of waste is changed from ammunition to medical waste, the feed rate is changed from one setting to another. Thereafter, as long as medical waste continues to be fed, the feed rate will remain the same. From our discussion above, this is an accident waiting to happen. In contrast, the present invention envisions continuing to vary the feed rate instantaneously based on the product gas flow rate and, consequently, the oxygen to product gas ratios generated by the constituents making up the waste. That is, the feed rate is not set at one rate for each type of waste. Rather, it continues to be varied to make sure the product gas flow rate and, consequently, the oxygen to product gas ratio are maintained at safe levels throughout the entire processing of the particular type of waste.

The point of the discussion just ended is that the safe operation of a pyrolytic system can be enhanced by controlling the waste which is fed into the system in order to control the product gas flow, and thus maintain safe oxygen to product gas ratios. One way of accomplishing this is by continuously varying the rate at which waste is fed into the system.

In the discussion above, the operation of the gas supply control unit 1 and the waste feed control unit 2 were discussed somewhat separately. In an illustrative embodiment of the present invention, systems envisioned by the present invention comprise units 1, 2 adapted to operate simultaneously. Operating both units 1,2 simultaneously provides the added advantage of coordinating the operation of the two units 1,2 in order to effectively maintain the ratio of oxygen to product gas within safe levels. In this way, the gas supply control unit 1 will feed a sufficient amount of an inert gas into the system 100 while the waste feed control unit 2 is simultaneously adjusting the amount of waste being fed into the system 100 to maintain the ratio at safe levels.

It should be understood that the units 1, 2 may operate simultaneously while waste is being processed and when the system 100 is started up or restarted. For example, from time to time the processing of waste may be interrupted (e.g., to remove molten material from the vessel 5). In an alternative embodiment of the invention, after such an interruption, as a safety precaution, control units envisioned by the present invention can be adapted to instantaneously feed an inert gas into the system 100 (e.g., to vessel 5, torch 1*a*, prechamber 2*a* and chamber 2*b*) to insure that there are no potentially explosive constituents of a product gas trapped within parts of the system 100 before processing is begun again. The injection of an inert gas into the system 100 is sometimes referred to as "purging" the system 100, the goal of which is to rid the system 100 of potentially explosive constituents before starting or restarting the processing of waste.

It should be understood that the methods and systems of the present invention discussed above effectively control the volume of oxygen with respect to the volume of product gas within the entire pyrolytic system 100. These methods and systems are not taught, disclosed or suggested by an existing system or a combination of existing systems.

The control systems discussed above go a long way towards enabling the safe operation of a pyrolytic system. Owing nothing to chance, however, the present invention envisions additional features to insure the safe operation of such a system by controlling the pressures within system 100.

Many waste processing systems, including incinerators and existing pyrolytic systems, control system pressures in order to maintain a slight vacuum. This is accomplished in existing pyrolytic systems and incinerators by adjusting the rotational speed of draft fans. As the volume of product gas and pressure increases, the speed of the fans is increased to draw larger volumes of gas (i.e., a high "flow rate") out of the system. Conversely, as the volume of product gas and pressure decreases, the speed is decreased to draw smaller volumes of gas out of the system (i.e., a low flow rate). The use of fans alone as the primary way to control pressure may be sufficient for an incinerator, but not for a pyrolytic system.

Before discussing the solutions envisioned by the present invention, some additional background needs to be provided. The use of fans as the primary way of controlling pressure in an incinerator is also dictated by the size of an incinerator. Incinerators tend to be large. They are designed to process large volumes of air and product gasses. When pressure surges do occur they tend to get "absorbed", or be "dampened", by these large volumes. In such a dampened system, even slow-responding fans can provide adequate pressure control. Again, the same is not true when it comes to pyrolytic systems.

Some of the limitations of this strategy (i.e., relying on fans alone to control pressures) are as follows. First, fans tend to change their speed slowly because of fan inertia. After significant experimentation, the present inventors have discovered that the time it takes to adjust such fans is too long. Surges in pyrolytic systems, if not quickly controlled, result in large and rapid increases in pressure. The present inventors realized that pyrolytic systems required instantaneous responses to surges in gas pressure in order to ensure their safe operation. This need could not be met by the use of fins alone. Second, pyrolytic systems generate smaller gas flow rates (i.e., smaller ratios of equipment volume to gas volumetric flow rates) than existing systems (i.e., incinerators). As a result, the "dampening" effects enjoyed by incinerators are not present within pyrolytic systems. Thus, fans alone cannot adequately maintain safe system pressures within a pyrolytic system. In fact, it is believed that any attempt to do so will result in blowback, a potentially unsafe situation described below.

When more than one composition of waste is introduced into the system 100, almost inevitably, some constituents or elements of the waste will rapidly generate an abnormally large volume of product gas. This causes surges in gas volumes and spikes in pressure within vessel 5 and system 100. Depending upon the type of waste being fed, empty space may exist within the feed conduit 2*c*. Driven by the increased pressure in the vessel 5, the product gas, containing flammable constituents such as hydrogen, may flow backwards (i.e., "blowback") through the partially empty conduit 2*c* into the feed chamber 2*b*. If oxygen is present in the feed chamber 2*b*, in levels of greater than 3% by volume, a potentially explosive gas mixture could form within the feed chamber.

It should be noted that, as described above, the gas supply unit 1 is adapted to maintain the oxygen concentration in feed chamber 2*b* below 3% by volume by continuously supplying an inert gas such as nitrogen. However, the present invention takes little for granted. The present inventors recognize that the presence of flammable gasses in the feed system is a potential safety risk, and thus a situation to be avoided. Thus, the present inventors realized that pyrolytic systems require instantaneous responses to surges in gas pressure in order to maintain desired system pressures and ensure their safe operation.

During their experiments, the present inventors also realized that there was a need to develop ways to maintain desired system pressures within a pyrolytic system during interruptions (e.g., during "idle" periods) in processing to ensure safe operation. During idle periods, pyrolytic systems rely on a plasma torch to supply the heat needed to maintain desired vessel temperatures. During these periods, pyrolytic systems generate extremely small amounts of product gas (i.e., low flow rates). Typically, these flow rates fall below the minimum flow rate drawn by draft fans when operating at their nominal, minimum speed. In this situation, systems relying solely on fan speed adjustments will be unable to maintain the desired system pressure. The system pressure will be lower than desired (excessive vacuum) due to the continuing "draw" of the fans, which may cause air to be sucked into the system through leakage points. The combination of low product gas flow and excessive air leakage can result in unsafe oxygen to product gas ratios.

In an illustrative embodiment of the present invention, system 100 comprises a pressure balancing control unit 3 adapted to control the pressure within system 100 during rapid surges or fluctuations in product gas flow rates and during idle periods. Rather than rely on draft fans alone, the present invention envisions the use of pressure balancing control unit 3, recirculation line 13, draft fan inlet damper 14*a*, draft fan discharge damper 14*b*, and recirculation damper 14*c* (collectively "dampers"). In an illustrative embodiment of the present invention, control unit 3 is adapted to instantaneously adjust the dampers 14*a*, 14*b* and 14*c* (e.g., in fractions of a second) to allow the rapid control of increased pressures throughout the system 100. In yet another illustrative embodiment of the invention, control unit 3 is adapted to instantaneously adjust the dampers 14*a*, 14*b* and 14*c* to allow the recirculation of product gas within system 100 to maintain safe system pressures during idle periods. This novel system can be understood by presenting some examples.

First, envision system 100 in an idle state, with no waste being fed into it and no product gas being generated. In this case, pressure balancing control unit 3 is adapted to set draft fans 15 at a predetermined speed (or speeds) to ensure that the fans 15 are capable of handling the maximum possible flow rate of product gas. In this situation, the control unit 3 is adapted to place the dampers 14*a*–14*c* in an idle position (i.e., draft fan discharge damper 14*b* is closed, and the recirculation damper 14*c* is in a fully open position). All product gas drawn through the draft fans 15 is recirculated. The control unit 3 is further adapted to set the draft fan inlet damper 14*a* so that it limits the flow of gas through the recirculation line 13. Since no gas is being exhausted from the system, the pressure in system 100 is not reduced below a desired value.

Next, envision the system 100 operating when a maximum amount of waste is being fed into the system and when a maximum amount of product gas (by volume) is being generated. In this case, the control unit 3 is adapted to set the draft fan discharge damper 14*b* to a fully open position, the recirculation damper 14*c* to a fully closed position and the draft fan inlet damper 14*a* to a fully open position. With the dampers in these positions the product gas is drawn out of the vessel 5 at the maximum flow rate and blown toward a thermal oxidizer 16.

These two states represent the extremes of "no product gas generation" and "maximum product gas generation." As envisioned by one embodiment of the present invention, the pressure balancing control unit 3 is adapted to instantaneously adjust the positions of the draft fan discharge damper 14*b*, the recirculation damper 14*c*, and the draft fan inlet damper 14*a* to maintain a desired pressure based on signals received from sensor 9 located within the vessel 5 as the system operates from one extreme to the other (and all intermediate states in between). The control unit 3 may adjust these dampers simultaneously or sequentially. By so doing, blowback can be minimized during surges, and the system 100 may be idled during processing interruptions.

As noted above, the dampers 14*a*–14*c* allow the draft fans 15 to be set at a predetermined speed (or speeds). Only the fan dampers need to be adjusted. This approach allows the fans 15 to operate under stable loads, thereby increasing their reliability.

It should be understood that while the dampers 14*a*–14*c* are allowing the system 100 to safely idle, no waste is fed into the system 100. Instead, control unit 1 is adapted to control the supply of the inert gas to maintain the proper oxygen to product gas ratio. During this time, the control unit 2 is adapted to terminate the feeding of waste to the system 100.

The theme running throughout the discussion above is the safe operation of a pyrolytic system. Besides the oxygen to product gas ratio and system pressures, another source of concern is the operation of the thermal oxidizer 16 (i.e., a controlled flare) located downstream of the draft fans 15.

In an illustrative embodiment of the present invention, interlocking control unit 4 is adapted to protect the system 100 from dangers (e.g., explosions) due to flame propagation from the thermal oxidizer 16.

The thermal oxidizer 16 is adapted to "burn off" flammable product gas drawn out of the system 100 by fans 15. Within the oxidizer 16, flammable product gas mixes with air. This mixture is then burned under controlled conditions. Normally, the flame generated by the thermal oxidizer 16 cannot propagate back (i.e., burn back up the pipe) into the system 100 because there is insufficient oxygen in the product gas to support combustion. However, again taking nothing for granted, the present inventors realized that if there were sufficient oxygen in the product gas, the flame could propagate backwards. This could possibly cause an explosion or deflagration in the scrubber 11.

Controlling the ratio of oxygen to product gas in the system below 3% provides a first level of protection to prevent such an occurrence. A second level of protection is provided by a flame arrestor 18 which is positioned between the draft fans 15 and the thermal oxidizer 16. This device is adapted to allow product gas to flow to the thermal oxidizer 16, while at the same time prohibiting the propagation of a flame in the reverse direction. Flames which propagate backwards into the flame arrestor 18 will typically be extinguished inside the device. Under some conditions, however, the flame may continue to bum inside the flame arrestor 18. Even then, the flame will be prevented from propagating further upstream as long as the flame arrestor 18 remains intact.

If a flame propagates back into the flame arrestor 18, and is allowed to burn there for an extended period, the flame arrestor 18 could eventually fail. If the flame arrestor 18 fails, the flame could continue to propagate into the scrubber 11 with potentially catastrophic results.

Yet a third level of protection is provided by the installation of a flame detector 19 within the flame arrestor and an automatic isolation valve 20 within the pipe 21. The flame detector 19 can detect the presence of a flame in the flame arrestor 18. Thereafter, the automatic isolation valve 20 can be closed immediately upstream of the flame arrestor 18. This action will help extinguish the flame by depriving it of additional fuel while preventing the flame from propagating upstream.

In existing systems, the isolation valve 20 is the last level of defense. If the valve 20 should fail, an explosion might occur within an existing system.

In an illustrative embodiment of the present invention, the system 100 further comprises interlocking control unit 4 adapted to control the system 100 in order to reduce the chance of an explosion due to a failure in the flame detector 19 or isolation valve 20.

More specifically, the unit 4 is adapted to receive signals from the flame detector 19 and/or isolation valve 20 which indicate their status. If the signals sent indicate a flame has propagated backwards or that the isolation valve 20 is closed then the control unit 4 is adapted to halt operations within the system 100, such as the feeding of waste into the system 100, halting the operation of the torch 1*a*, idling the fans 15 and controlling the supply of an inert gas into the system 100. These actions are designed to reduce pressures as well as the oxygen to product gas ratio within the system 100 which in turn reduces the risk that a flame could propagate into the scrubber 11 in the event that the isolation valve 20 fails.

It should be understood that the gas supply control unit 1, waste feed control unit 2, pressure balancing control unit 3 and interlocking control unit 4 can all operate simultaneously and/or in some sequence to maintain the safety of system 100.

The above discussion focuses on systems and devices for the safe processing of hazardous waste. It should be understood that the present invention also envisions methods and programmed mediums 1*a*–4*a* (e.g., floppy disks, CDs, hard drives, and other electronic storage devices adapted to store computer programs, code or the like and which may be adapted to be used with the control units) adapted to control and carry out the features and functions described above. In addition, it should be understood that the features and functions described above can be incorporated within fixed or mobile waste processing systems, as well as within other systems, such as those discussed in co-pending U.S. patent application Ser. No. 09/667,764 entitled "Ruggedized Methods And Systems For Processing Hazardous Waste".

Though shown as separate units in FIG. 1, it should be understood that the waste, gas supply, pressure balancing and interlocking control units may be combined to form fewer than four control units or may be broken down to form more than four control units.

We claim:

1. A pyrolytic waste processing system comprising:

a waste processing vessel including at least one plasma arc torch for pyrolizing waste in said processing vessel, the pyrolizing of waste generating product gases;

a feed chamber for receiving waste and feeding the waste into said waste processing vessel;

a scrubber in communication with said waste processing vessel for receiving, cooling and cleaning product gases generated within said waste processing vessel;

a thermal oxidizer in communication with said scrubber for receiving and burning off product gases generated within said waste processing vessel;

a gas supply unit for supplying gas to said plasma arc torch;

a gas composition sensor for detecting a ratio of oxygen to product gases within said system; and a gas supply control unit coupled to said composition sensor and to said gas supply unit for causing said gas supply unit to switch the gas supplied to the plasma arc torch from air to an inert gas in response to signals received from the gas composition sensor indicating that the ratio of oxygen to product gases within said system is above a predetermined threshold.

2. The system of claim 1, wherein the predetermined ratio is 3% by volume.

3. The system of claim 1, further comprising a prechamber in communication with said feed chamber and through which waste is delivered to said feed chamber, and wherein:

said gas supply unit communicates with said prechamber for feeding inert gas to the prechamber; and said gas supply control unit controls the amount of inert gas fed to the prechamber to maintain the volume percentage of oxygen relative to other gases in the prechamber below a predetermined threshold.

4. The system of claim 3, wherein said prechamber includes a first gate that opens for receiving waste and a second gate that opens for allowing the waste to enter said feed chamber.

5. The system of claim 1, wherein said gas supply unit communicates with said feed chamber for feeding inert gas to said feed chamber and wherein said gas supply control unit controls the amount of inert gas fed to said feed chamber in response to signals received from said gas composition sensor.

6. The system of claim 1, wherein:

said waste processing vessel includes a tap for removing molten material from said processing vessel;

said gas supply unit being in communication with said tap for feeding inert gas to said tap; and said gas supply control unit controlling the amount of inert gas fed to said tap in response to signals received from said gas composition sensor.

7. The system of claim 1, and further comprising at least one draft fan for drawing product gas out of said waste processing vessel and through said scrubber to maintain a predetermined pressure within said vessel, and wherein said gas supply unit communicates with said draft fan for feeding inert gas to said draft fan; and wherein said gas supply control unit controls the amount of inert gas fed to said draft fan in response to signals received from said gas composition sensor.

8. The system of claim 1, and wherein said gas supply control unit further controls said gas supply unit for switching the gas supplied to said plasma arc torch from inert gas back to air in response to signals received from said gas composition sensor indicating that the ratio of oxygen to product gases is below a predetermined threshold.

9. The system of claim 1, and wherein said gas supply unit delivers gas through a manifold coupled to said plasma arc torch.

10. The system of claim 1, and further comprising a waste feed control unit coupled to said feed chamber for varying the rate at which waste is fed into said waste processing vessel, said waste feed control unit varying the feed rate based upon said gas composition sensor.

11. The system of claim 10, wherein said gas supply control unit and said waste feed control unit operate concurrently.

12. The system of claim 1, wherein the inert gas comprises nitrogen.

13. The system of claim 1, further comprising:

at least one draft fan in communication with said scrubber for drawing product gases out of said waste processing vessel through said scrubber to maintain a predetermined maximum pressure within said waste processing vessel and said scrubber, said draft fan being in communication with and delivering product gases to said thermal oxidizer, and a recirculation line for recirculating product gases from said draft fan through said scrubber;

a draft fan inlet damper for regulating a flow of product gases from said scrubber to said draft fan;

a draft fan discharge damper for regulating a flow of product gases from said draft fan to said thermal oxidizer;

a draft fan recirculation damper for regulating a flow of product gases from said draft fan to said recirculation line; and a pressure balancing control unit coupled to said draft fan inlet damper, said draft fan discharge damper, and said draft fan recirculation damper to control the flows of product gases and thus to control pressures within said system.

14. The system of claim 13, wherein said pressure balancing control unit controls said draft fan inlet damper, said draft fan discharge damper, said draft fan recirculation damper to allow recirculation of product gases through said scrubber during interruptions in waste processing.

15. The system of claim 1, further comprising:

at least one draft fan for drawing product gases out of said waste processing vessel through said scrubber and delivering the product gases to said thermal oxidizer; and a flame arrestor positioned between said draft fan and said thermal oxidizer for extinguishing flames propagating upstream from said thermal oxidizer towards said draft fan.

16. The system of claim 15, further comprising:

a flame detector in said flame arrestor for detecting a flame within said flame arrestor; and an isolation valve positioned upstream from the flame arrestor, said isolation valve being adapted to close when said flame detector detects the presence of a flame.

17. The system of claim 16, further comprising:

a draft fan inlet damper for regulating flow of product gases into said draft fan;

a draft fan discharge damper for regulating flow of product gases from said draft fan to said thermal oxidizer;

a draft fan recirculation damper for regulating flow of product gases from said draft fan to said recirculation line; and an interlocking control unit for receiving signals from said isolation valve, said interlocking control unit closing said draft fan discharge damper, opening said draft fan recirculation damper, halting operation of said plasma arc torch, and halting the feeding of waste into said waste processing vessel upon closure of said isolation valve.

18. The system of claim 15, further comprising:

a flame detector for detecting the presence of a flame within said flame arrestor;

a draft fan inlet damper for regulating flow of product gases into said draft fan;

a draft fan discharge damper for regulating flow of product gases from said draft fan to said thermal oxidizer;

a draft fan recirculation damper for regulating flow of product gases from said draft fan to said recirculation line; and an interlocking control unit for receiving signals from said flame detector, said interlocking control unit closing said draft fan discharge damper, opening said draft fan recirculation damper, halting operation of said plasma arc torch and halting the feeding of waste into said waste processing vessel when said flame detector detects the presence of a flame.

19. A pyrolytic waste processing system comprising:

a waste processing vessel including at least one plasma arc torch for pyrolizing waste within said waste processing vessel, the pyrolizing of waste generating product gases;

a feed chamber in communication through a feed conduit with said waste processing vessel for feeding waste to be pyrolized into said waste processing vessel;

a gas supply unit in communication with at least said plasma arc torch for delivering gas to said torch and, through said torch, to said waste processing vessel;

a gas composition sensor for sensing a ratio of oxygen to product gases in said system;

an exhaust conduit for directing gases away from said waste processing vessel;

a scrubber in communication with said exhaust conduit for cooling and cleaning product gases generated within said waste processing vessel;

a gas supply control unit coupled to said composition sensor and to said gas supply unit for causing said gas supply unit to supply an inert gas at least to said plasma arc torch in response to signals received from said gas composition sensor indicating that the ratio of oxygen to product gases in said system is in excess of a predetermined threshold, thereby maintaining a safe ratio of oxygen to product gases in said system.

20. The system of claim 19, and further comprising:

a thermal oxidizer communicating with said exhaust conduit downstream of said scrubber for burning off product gases generated within said waste processing vessel;

a flame arrestor in said exhaust conduit upstream of said thermal oxidizer for extinguishing flames propagating upstream from said thermal oxidizer;

a flame detector in said flame arrestor for detecting a flame within said flame arrestors;

an isolation valve upstream from said flame arrestor, said isolation valve being adapted to close when said flame detector detects a flame; and an interlocking control unit coupled to said flame detector and to said gas supply unit for receiving signals from said flame detector, and controlling a supply of inert gas to said system in response thereto.

21. The system of claim 19, further comprising:

a flame arrestor for extinguishing flames propagating upstream from said thermal oxidizer;

a flame detector for detecting a flame within said flame arrestor;

an automatic isolation valve positioned upstream from said flame arrestor that closes when said flame detector detects a flame; and an interlocking control unit coupled to receive signals from said isolation valve, said interlocking control unit controlling said gas supply unit to supply inert gas to said system in response to closure of said isolation valve.

22. The system of claim 19, and further comprising a waste feed control unit coupled to said feed chamber for varying the rate at which waste is supplied to said waste processing chamber in response to signals received from the gas composition sensor, said waste feed control unit operating concurrently with said gas supply control unit in order to maintain a preselected ratio of oxygen to product gas in the system.

23. A pyrolytic waste processing system comprising:

a waste processing vessel including at least one plasma arc torch for pyrolizing waste within said waste processing vessel, the pyrolizing of waste producing product gases;

a feed chamber coupled to said waste processing vessel through a feed conduit for delivering waste to said waste processing vessel;

an exhaust conduit communicating with said waste processing vessel for directing product gases generated within said waste processing vessel away from said waste processing vessel;

a scrubber communicating with said exhaust conduit for cleaning and cooling product gas generated within said waste processing vessel;

a thermal oxidizer communicating with said exhaust conduit downstream of said scrubber for receiving and burning off product gases generated within waste processing vessel;

a gas composition sensor for detecting a ratio of oxygen to product gases in said system; and a waste feed control unit coupled to said gas composition sensor and to said feed chamber for varying the rate at which waste is fed to said waste processing vessel in response to signals from said gas composition sensor to maintain a preselected ratio of oxygen to product gases in said system.

* * * * *